US006977469B2

(12) United States Patent
Seinen et al.

(10) Patent No.: US 6,977,469 B2
(45) Date of Patent: Dec. 20, 2005

(54) LOW-PRESSURE MERCURY VAPOR DISCHARGE LAMP

(75) Inventors: Peter Arend Seinen, Turnhout (BE); Josephus Theodorus Van Der Eyden, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 138 days.

(21) Appl. No.: 10/476,808

(22) PCT Filed: May 8, 2002

(86) PCT No.: PCT/IB02/01635

§ 371 (c)(1),
(2), (4) Date: Nov. 4, 2003

(87) PCT Pub. No.: WO02/091423

PCT Pub. Date: Nov. 14, 2002

(65) Prior Publication Data

US 2004/0130257 A1 Jul. 8, 2004

(30) Foreign Application Priority Data

May 8, 2001 (EP) ..... 01201663

(51) Int. Cl.[7] ..... H01J 17/02
(52) U.S. Cl. ..... 313/613; 313/616; 313/492
(58) Field of Search ..... 313/238, 239, 313/352, 492, 493, 609, 613, 616

(56) References Cited

U.S. PATENT DOCUMENTS 6,646,365 B1 * 11/2003 Denissen et al. ..... 313/238

FOREIGN PATENT DOCUMENTS

GB 2147735 A * 5/1985 ..... H01J 61/04

* cited by examiner

*Primary Examiner*—Vip Patel

(57) ABSTRACT

Low-pressure mercury vapor discharge lamp comprising a discharge vessel (10) having a first and a second end portion (12*a*, 12*b*), the discharge vessel (10) containing mercury and a rare gas, wherein the end portions (12*a*, 12*b*) each support an electrode (20*a*,20*b*) arranged in the discharge vessel (10) for initiating and maintaining a discharge in the discharge vessel (10), wherein an electrode shield (22*a*,22*b*) substantially encompasses at least one of the electrodes (20*a*,20*b*), and wherein said electrode shield (22*a*,22*b*) comprises an inner wall (23*a*) and an outer wall (24*a*), said walls (23*a*, 24*a*) being spaced apart.

23 Claims, 2 Drawing Sheets

LOW-PRESSURE MERCURY VAPOR DISCHARGE LAMP

The invention concerns a low-pressure mercury vapor discharge lamp comprising a discharge vessel having a first and a second end portion, the discharge vessel containing mercury and a rare gas, wherein the end portions each support an electrode arranged in the discharge vessel for initiating and maintaining a discharge in the discharge vessel, and wherein and electrode shield substantially encompasses at least one of the electrodes.

Such a low-pressure mercury vapor discharge lamp is described in the non-prepublished European patent application No. EP 0011119 (PHD 99.160). With this lamp the electrode shield is manufactured from stainless steel sheet material that is formed into a tube.

In mercury vapor discharge lamps mercury forms the primary component for the (efficient) generation of ultraviolet (UV) light. On an inner wall of the discharge vessel a luminescent layer comprising a luminescent material (such as fluorescent powder) is present to convert UV into other wavelengths, such as UV-B and UV-A for tanning purposes (sun beds), or to visible radiation. Such discharge lamps are for this reason also referred to as fluorescent lamps.

In the description and claims of the present invention the expression "nominal operation" is used in order to refer to operating conditions in which the mercury vapor pressure is such that the radiation output of the lamp is at least 80% of that during optimum operation, meaning under operating conditions in which the mercury vapor pressure is at its optimum.

For correct operation of low-pressure mercury vapor discharge lamps the electrodes of such discharge lamps comprise an (emitter) material with a low so-called work function (lowering of the output potential) for the delivery of electrons to the discharge (cathode function) and the receipt of electrons from the discharge (anode function). Known materials with a low work function are, for example, barium (Ba), strontium (Sr) and Calcium (Ca). It is noted that during ignition and during operation of low-pressure mercury vapor discharge lamps material (barium and/or strontium) evaporates and sputters from the electrode(s). In general the emitter material is deposited on the inner wall of the discharge vessel and on the electrode shield, if the low-pressure discharge lamp includes such an electrode shield. It also appears that the above-mentioned Ba and Sr that is deposited elsewhere in the discharge vessel no longer takes part in the light generating process. The deposited (emitter) material also forms mercury-containing amalgams on the inner wall, as a result of which the quantity of mercury available for the discharge (gradually) falls, which can adversely affect the lifetime of the lamp. In order to compensate for such a loss of mercury during the life of the lamp, in the lamp a relatively high dose of mercury is necessary which is undesirable from the environmental point of view.

By providing an electrode shield that encompasses the electrode(s) and that during nominal operation has a temperature that is higher than 250° C., there is a fall in the reactivity of materials in and on the electrode shield for reaction with the mercury present in the discharge vessel to prevent the formation of amalgams (Hg—Ba, Hg—Sr).

Experiments have also shown that the emitter material, that evaporates from the electrode, forms oxides (BaO or SrO). During (nominal) operation of the discharge lamp mercury forms a bond with such oxides of evaporated emitter material. If reactive oxygen is present in the vicinity of the electrode, BaO, SrO and/or HgO are formed, and possibly also $SrHgO_2$ and $BaHgO_2$. If tungsten (from the electrode) is also deposited (during cold starts sputtering of tungsten takes place), $WO_x$ and $HgWO_x$ are also formed. Without it being necessary to give a theoretical explanation, it seems that, although BaO and SrO under normal thermal conditions do not react with mercury, the presence of the discharge in the discharge area plays a role in the formation of these compounds of mercury and the oxides of evaporated emitter material. At temperatures higher than 450° C. the mercury is released again, due to dissociation of the said compounds of mercury and the oxides of evaporated emitter material, and the released mercury is again available for discharge. HgO, BaO and SrO in particular dissociate from 450° C. upwards. The compounds $SrHgO_2$ and $BaHgO_2$ are somewhat more stable, the dissociation of these requiring a higher temperature of at least 500° C.

The aim of the invention is an efficient low-pressure mercury vapor discharge lamp of the kind described in the opening that uses less mercury.

To that end the electrode shield comprises an inner wall and an outer wall that are spaced apart. In this way an electrode shield is obtained with good insulating characteristics, so that the temperature of the inner wall is higher than for a single wall so that, as described above, less mercury is bonded. For a good insulating effect the spacing between the inner wall and the outer wall is preferably between 0.2 mm and 2 mm.

Preferably the electrode shield is manufactured predominantly from a single piece of sheet material, and preferably it is manufactured from stainless steel. Stainless steel is a material that is resistant to high temperatures. The material has, compared with iron for example, a high corrosion resistance, a relatively low thermal conduction coefficient and a relatively poor thermal emissivity. By manufacturing the shield from a single piece of sheet material it can be produced in a low-cost manner.

Preferably the electrode shield is provided on a side facing away from the electrode with a low emissivity coating layer to reduce radiation losses of the electrode shield, which coating layer preferably contains a precious metal or chrome. By applying such a layer to the outer surface of the electrode shield it is simpler to reach the desired relatively high temperatures of the electrode shield. Other suitable materials for a low-emissivity coating layer on the outer surface of the electrode shield are titanium nitride, chromium carbide, aluminum nitride and silicon carbide. In an alternative embodiment of the low-pressure mercury vapor lamp the outer surface is polished. The polishing treatment of the outer surface of the electrode shield also reduces the radiation of heat through the electrode shield.

The electrode shield is preferably provided on a side directed towards to the electrode with an absorbent coating layer for absorption of radiation, which coating layer preferably contains carbon. By using a layer with a relatively high emissivity in the infra-red radiation range, the heat absorbing power of the electrode shield is increased. In this way it is simpler to reach the desired relatively high temperatures of the electrode shield.

The invention will now be explained in more detail using an example and the figures, in which.

Figure 1:
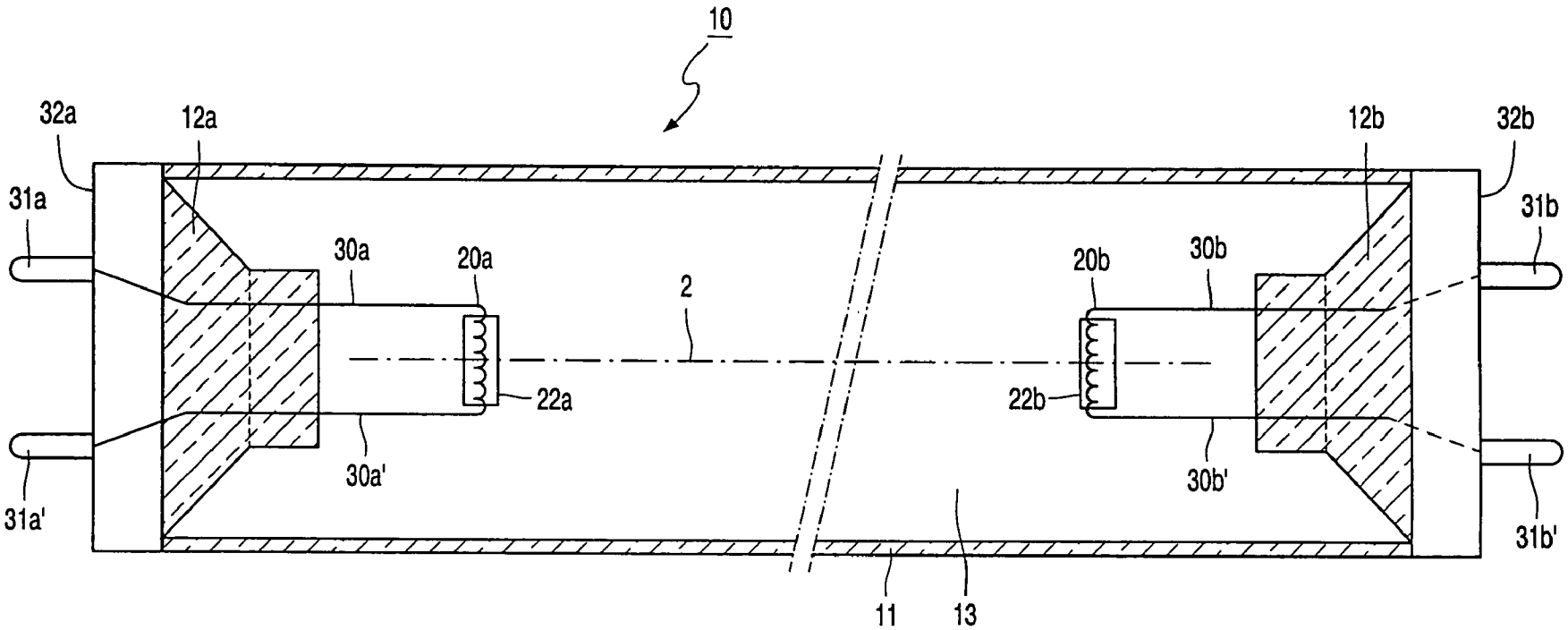
FIG. 1 is a schematic and longitudinal cross-sectional representation of an embodiment of the low-pressure mercury vapor discharge lamp in accordance with the invention.

FIG. 1 shows a low-pressure mercury vapor discharge lamp provided with a glass discharge vessel 10 with a tubular portion 11 around a longitudinal axis 2, which discharge vessel allows the radiation generated in the discharge vessel 10 to pass through and is provided with a first and a second end portion 12*a*, 12*b*. In this example the tubular portion 11 has a length of 120 cm and an internal diameter of 24 mm. The discharge vessel 10 encompasses in a gas-tight manner a discharge area 13 provided with a filling of 1 mg of mercury and an inert gas, for example argon. The wall of the tubular portion is customarily coated with a luminescent layer (not shown in FIG. 1), comprising a luminescent material (for example fluorescent powder), that converts the ultraviolet (UV) light generated by the mercury excited as it is incident into (predominantly) visible light. End portions 12*a*, 12*b* each support an electrode 20*a*, 20*b* arranged in the discharge area 13. The electrode 20*a*, 20*b* is a winding of tungsten that is covered with an electron-emitting substance, in this case a mixture of barium, calcium and strontium oxide. From the electrodes 20*a*, 20*b* current supply conductors 30*a*, 30*a*', 30*b*, 30*b*' extend through the end portions 12*a*, 12*b* to the outside of the discharge vessel 10. The current supply conductors 30*a*, 30*a*', 30*b*, 30*b*', are connected with contact pins 31*a*, 31*a*', 31*b*, 31*b*' that are secured to a lamp base 32*a*, 32*b*. Generally around each electrode 20*a*, 20*b* an electrode ring is arranged (not shown in FIG. 1), on which a glass capsule is clamped, through which mercury is dosed. In an alternative embodiment, an amalgam—comprising mercury and an alloy of PbBiSn is provided in an exhaust tube (not shown in FIG. 1) that is connected with the discharge vessel 10.

In the embodiment of FIG. 1 the electrode 20*a*, 20*b* is encompassed by a double-walled electrode shield 22*a*, 22*b*, that in nominal operation has a temperature that is higher than 450° C. At the said temperatures, dissociation causes mercury that is bonded to BaO or SrO on the electrode shield 22*a*, 22*b* to be released and become available again for discharge in the discharge area. A particularly suitable temperature of the electrode shield is at least 550° C. In the example of FIG. 1 the electrode shield 22*a* is manufactured from stainless steel. Such an electrode shield is, at the said high temperatures, dimensionally stable, corrosion-resistant and has a relatively low heat emissivity. A suitable material for the manufacture of the electrode shield is chromium nickel steel (AlSi 316) having the following composition (in % by weight): a maximum of 0.08% C, a maximum of 2% Mn, a maximum of 2–3% Mo and the remainder Fe. A further particularly suitable material for the manufacture of the electrode shield is Duratherm 600, a CoNiCrMo alloy with an increased corrosion resistance and having the following composition: 41.5% CO, 12% Cr, 4% Mo, 8.7% Fe, 3.9% W, 2% Ti, 0.7% Al and the remaining % Ni.

Figure 2:
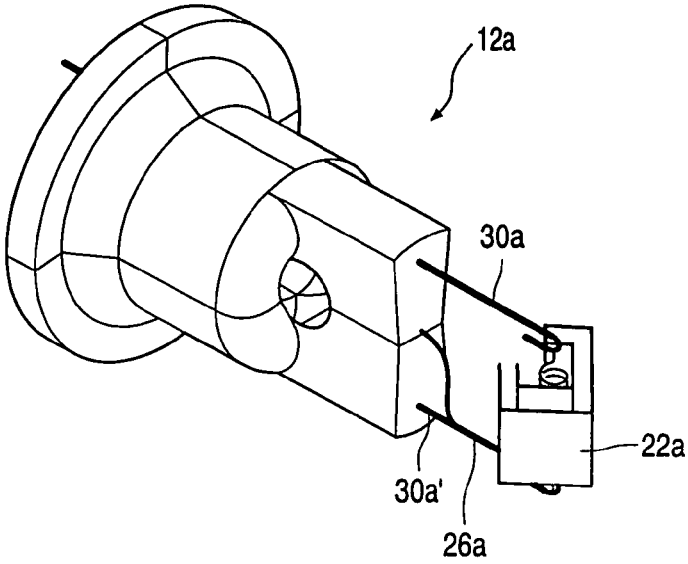
FIG. 2 is a perspective view of a detail of FIG. 1.

FIG. 2 is a perspective view of a detail of FIG. 1, wherein the end portion 12*a* supports the electrode 20*a* via the current supply conductors 30*a*, 30*a*'. The double-walled electrode shield 22*a* is supported by a support wire 26*a* that in this example is positioned in the end portion 12*a*. In an alternative embodiment the support wire 26*a* is connected with one of the current supply conductors 30*a*, 30*a*'. In the example of FIG. 2 the support wire 26*a* is made from stainless steel. Stainless steel has a relatively very low thermal conduction coefficient relative to the known materials (iron, for example) that are used as the support wire. The electrode shield 22*a* can maintain a relatively high temperature, inter alia because the support wire 26*a* effectively reduces heat discharge from the electrode shield 22*a*. In a further alternative embodiment the electrode shield is mounted directly on the current supply conductors, for example through the electrode shield being provided with constrictions that are a press fit on the current supply conductors.

Figure 3:
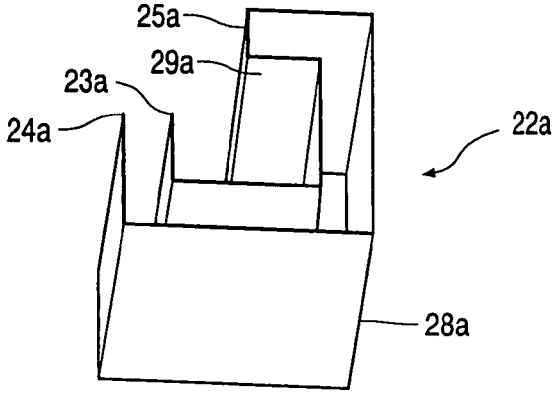
FIG. 3 is a perspective view of a detail of FIG. 2.

FIG. 3 shows a perspective view of an embodiment of the essentially quadrangular electrode shield 22*a* as shown in FIG. 2, comprising an inner wall 23*a*, and an outer wall 24*a* that at least substantially encompasses the outer wall 24*a*, and a connecting portion 25*a*. The electrode shield does not necessarily have to be quadrangular in shape, but can for example also be cylindrical, triangular or polyangular in cross-section. The electrode shield in this example is manufactured from a single piece of sheet material, and in the connecting portion 25*a* the central piece is removed, for example by punching, so that only two connecting limbs remain on the side edges, which enhances the insulating effect between the inner wall 23*a* and the outer wall 24*a*. In order to be able to achieve temperatures of the inner wall 23*a* of the electrode shield 22*a* in excess of 450° in operation, preferably of at least 550° C., an outer surface of the outer wall 24*a* of the electrode shield 22*a* is provided with a low-emissivity coating layer 28*a* to reduce radiation losses of the electrode shield 22*a*. The low-emissivity coating layer 28*a* preferably comprises a chromium film. In an alternative embodiment the low-emissivity coating layer 28*a* comprises a precious metal, for example a gold film. Also in FIG. 3, the inner wall 23*a* of the electrode shield 22*a* is provided on an inner surface with an absorbent coating layer 29*a* for absorption of (heat) radiation. The absorbent coating layer 29*a* preferably comprises carbon.

Figure 4:
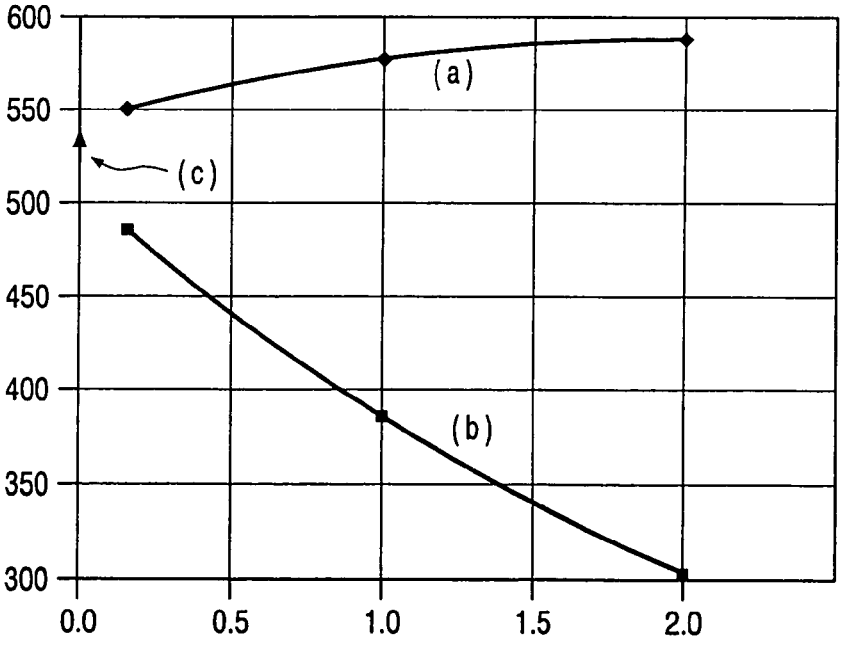
FIG. 4 is a representation of the average wall temperature of an electrode shield of a low-pressure mercury vapor discharge lamp in accordance with the invention as a function of the spacing between the walls.

The spacing between the two wall portions 23*a*, 24*a* is preferably between 0.2 and 2 mm. FIG. 4 shows, for an embodiment, the relation between the wall spacing on the one hand and the average wall temperature (a) of the inner wall and the average wall temperature (b) of the outer wall on the other hand. "(c)" gives the temperature that is reached with a single wall, or with a wall spacing of 0 mm. The graph shows clearly that a double wall results in a higher temperature of the inner wall 23*a* than a single wall, and that a greater spacing between the two wall portions 23*a*, 24*a* likewise contributes to a higher temperature, but that the effect of this drops as the wall spacing increases. It is conceivable that the wall spacing should not be too great, since otherwise the "double-wall" effect is lost.

What is claimed is:

1. A low-pressure mercury vapor discharge lamp comprising a discharge vessel (10) having a first and a second end portion (12*a*, 12*b*), the discharge vessel (10) containing mercury and an inert gas, wherein the end portions (12*a*, 12*b*) each support an electrode (20*a*,20*b*) arranged in the discharge vessel (10) for initiating and maintaining a discharge in the discharge vessel, and wherein a double walled electrode shield (22*a*,22*b*) substantially encompasses at least one of the electrodes (20*a*,20*b*), said double walled electrode shield (22*a*,22*b*) comprising an inner wall (23*a*) and an outer wall (24*a*), which walls are spaced apart, a space between the inner wall (23*a*) and the outer wall (24*a*) being between 0.2 mm and 2 mm.

2. The low-pressure mercury vapor discharge lamp as claimed in claim 1, wherein the electrode shield (22*a*, 22*b*) is substantially manufactured from a single piece of sheet material.

3. The low-pressure mercury vapor discharge lamp an of claim 2, wherein the single piece of sheet material is manufactured from stainless steel.

4. The low-pressure mercury vapor discharge lamp of claim 2, wherein the single piece of sheet material is manufactured from chromium nickel steel having a composition comprising in percent by weight of a maximum of 0.08% C, a maximum of 2% Mn, a maximum of 2–3% Mo and a remainder Fe.

5. The low-pressure mercury vapor discharge lamp of claim 2, wherein the single piece of sheet material is manufactured from a CoNiCrMo alloy having a composition of: 41.5% CO, 12% Cr, 4% Mo, 8.7% Fe, 3.9% W, 2% Ti, 0.7% Al and a remaining % Ni.

6. The low-pressure mercury vapor discharge lamp as claimed in claim 1, wherein the electrode shield (22*a*, 22*b*) is provided on an outer wall (24*a*) with a low-emissivity coating layer (28*a*) to reduce radiation losses of the electrode shield (22*a*, 22*b*).

7. The low-pressure mercury vapor discharge lamp as claimed in claim 6, wherein the low-emissivity coating layer comprises a material selected from the group consisting of a precious metal, titanium nitride, chromium carbide, aluminum nitride and silicon carbide.

8. The low-pressure mercury vapor discharge lamp of claim 6, wherein the low-emissivity coating layer is polished which reduces the radiation of heat through the electrode shield (22*a*, 22*b*).

9. The low-pressure mercury vapor discharge lamp of claim 6, wherein the low-emissivity coating layer comprises a precious metal.

10. The low-pressure mercury vapor discharge lamp of claim 9, wherein the chromium nickel-steel is (AlSi 316).

11. The low-pressure mercury vapor discharge lamp as claimed in claim 1, wherein the electrode shield (22*a*, 22*b*) is provided, on an inner side wall with an absorbent coating layer to absorb radiation.

12. The low-pressure mercury vapor discharge lamp as claimed in claim 11, wherein the absorbent coating layer contains carbon.

13. The low-pressure mercury vapor discharge lamp of claim 1, wherein the double-walled electrode shield 22*a*, 22*b* has a nominal operating temperature higher than 450 C.

14. The low-pressure mercury vapor discharge lamp of claim 13, wherein the nominal operating temperature is such that the radiation output of the lamp is at least 80% of that during which the mercury vapor pressure is at its optimum.

15. The low-pressure mercury vapor discharge lamp of claim 13, wherein the operational temperature causes the lamp to be dimensionally stable, corrosion-resistant and have a relatively low heat emissivity.

16. The low-pressure mercury vapor discharge lamp of claim 15, wherein the precious metal is a gold film.

17. The low-pressure mercury vapor discharge lamp of claim 1, wherein the cross-section of the electrode shield is selected from the group consisting of quadrangular, cylindrical, triangular and poly-angular.

18. A low-pressure mercury vapor discharge lamp comprising a discharge vessel (10) having a first and a second end portion (12*a*, 12*b*), the discharge vessel (10) containing mercury and an inert gas, wherein the end portions (12*a*, 12*b*) each support an electrode (20*a*,20*b*) arranged in the discharge vessel (10) for initiating and maintaining a discharge in the discharge vessel, and wherein a double walled electrode shield (22*a*,22*b*) substantially encompasses at least one of the electrodes (20*a*,20*b*), wherein said double walled electrode shield (22*a*,22*b*) comprises an inner wall (23*a*) and an outer wall (24*a*), which walls are spaced apart and wherein the inner wall (23*a*) is substantially encompassed by the outer wall (24*a*) and is connected to the outer wall (24*a*) by a connecting portion (25*a*), the inner wall (23*a*) and outer wall (24*a*) being comprised of three or more sub-wall regions, wherein respective sub-wall regions are proximally aligned and are spaced apart, each sub-wall region of the respective inner wall (23) and outer wall (24) forming a substantially right angle with an adjoining sub-wall region.

19. A low-pressure mercury vapor discharge lamp of claim 18, wherein the spacing is between 0.2 mm and 2 mm.

20. A low-pressure mercury vapor discharge lamp of claim 18, comprised of four or more sub-wall regions.

21. A low-pressure mercury vapor discharge lamp of claim 18, wherein a central portion of the connecting portion (25*a*) is removed to enhance an insulating effect between the inner wall (23*a*) and the outer wall (24*a*).

22. A low-pressure mercury vapor discharge lamp of claim 18, wherein the electrode shield (22) is constructed from a single piece of sheet material.

23. A low-pressure mercury vapor discharge lamp comprising a discharge vessel (10) having a first and a second end portion (12*a*, 12*b*), the discharge vessel (10) containing mercury and an inert gas, wherein the end portions (12*a*, 12*b*) each support an electrode (20*a*,20*b*) arranged in the discharge vessel (10) for initiating and maintaining a discharge in the discharge vessel, and wherein a double walled electrode shield (22*a*,22*b*) substantially encompasses at least one of the electrodes (20*a*,20*b*), said double walled electrode shield (22*a*,22*b*) comprising an inner wall (23*a*) and an outer wall (24*a*), which walls are spaced apart; wherein respective sub-wall regions are proximally aligned and are spaced apart, and wherein the inner wall (23*a*) is substantially encompassed by the outer wall (24*a*) and is connected to the outer wall (24*a*) by a connecting portion (25*a*).

* * * * *